US006917162B2

(12) United States Patent
Dayton, Jr.

(10) Patent No.: US 6,917,162 B2
(45) Date of Patent: Jul. 12, 2005

(54) TRAVELING WAVE TUBE

(75) Inventor: James A. Dayton, Jr., Cleveland, OH (US)

(73) Assignee: Genvac Aerospace Corporation, Richmond Heights, OH (US)

( * ) Notice: Subject to any disclaimer, the term of this patent is extended or adjusted under 35 U.S.C. 154(b) by 0 days.

(21) Appl. No.: 10/367,428

(22) Filed: Feb. 13, 2003

(65) Prior Publication Data

US 2003/0151366 A1 Aug. 14, 2003

Related U.S. Application Data

(60) Provisional application No. 60/356,524, filed on Feb. 13, 2002.

(51) Int. Cl.[7] ..... H01J 25/34; H01P 1/18

(52) U.S. Cl. ..... 315/39.3; 315/39; 333/157; 333/156

(58) Field of Search ..... 315/39.3, 39, 3.5; 333/157, 156, 162; 330/43

(56) References Cited

U.S. PATENT DOCUMENTS

| | | | | | |
|---|---|---|---|---|---|
| 4,093,892 | A | * | 6/1978 | Vanderplaats | 315/3.5 |
| 4,947,467 | A | * | 8/1990 | Manoly et al. | 315/3.5 |
| 5,038,076 | A | * | 8/1991 | Smith et al. | 315/3.5 |
| 5,071,055 | A | * | 12/1991 | Grauleau et al. | 228/122.1 |
| 5,274,304 | A | * | 12/1993 | Nishida | 315/3.5 |
| 5,341,066 | A | * | 8/1994 | Karsten et al. | 315/3.5 |
| 5,754,006 | A | * | 5/1998 | Tonegawa | 315/3.5 |
| 6,048,242 | A | * | 4/2000 | Reinhardt et al. | 445/23 |
| 6,244,212 | B1 | | 6/2001 | Takacs et al. | 118/723 EB |
| 6,301,333 | B1 | | 10/2001 | Mearini et al. | 378/143 |
| 6,584,675 | B1 | * | 7/2003 | Rajan et al. | 29/600 |

OTHER PUBLICATIONS

Company Commercialization Report, Dayton et al., "Miniature Traveling Wave Tubes for Space Application." pp. 3–20, Proposal #F021–1141, Jan. 16, 2002.

NASA Contract Report 182183, D. Wilson, "A Millimeter–Wave Tunneladder TWT," pp. 1–51, Oct. 1988.

Norman Noble, Inc., Website, "Laser Machining Services," Jan. 21, 2003 at http://www.nnoble.com /Laser_cutting.htm.

PhotoMachining , Inc., Website, "Materials for PhotoMachining," pp. 1–3, Jan. 21, 2003 at http://www.photomachining.com/materials.html.

(Continued)

*Primary Examiner*—Tuyet Thi Vo
(74) *Attorney, Agent, or Firm*—Fay, Sharpe, Fagan, Minnich & McKee, LLP

(57) ABSTRACT

A slow wave circuit (10, 110) of a traveling wave tube includes a three-dimensional conductive structure (30, 130). A dielectric film (36, 136) coats selected portions of the three-dimensional conductive structure (30, 130). An outer housing (12, 14, 112, 114) surrounds the three-dimensional conductive structure (30, 130) . The outer housing (12, 14, 112, 114) includes interior surfaces that connect with the dielectric film (36, 136). In a method for generating or amplifying microwave energy, a three-dimensional conductive structure is laser micromachined to define a selected generally periodic pattern thereon. The conductive structure is arranged inside a generally hollow barrel. An electron beam passes through the generally hollow three-dimensional structure and interacts with the conductive structure and the generally hollow barrel to generate or amplify the microwave energy.

16 Claims, 6 Drawing Sheets

OTHER PUBLICATIONS

Potomac Website, "An Introduction to Laser Micromachining, " Jan. 21–22, 2003 at http://www.potomac–laser.com/technology_tutorial.htm "UV Laser Tools for Micromachining of Diamond," pp. 1–4, Jan. 21, 2003 at http://www.potomac–laser.com/technology_diamond.htm.

Lasag Website, "Cutting," pp. 1 Jan. 21, 2003 at http://www.lasag.com/lasag_e/applications/cutting.htm.

TechTarget Network Website, "Traveling–Wave Tube," pp. 1–3 Jan. 17, 2003 at http://whatis.techtarget.com/definition/0..sid9 gci284003.00.html.

* cited by examiner

TRAVELING WAVE TUBE

This application claims the benefit of U.S. Provisional Application No. 60/356,524, filed Feb. 13, 2002, inventor James A. Dayton, Jr.

BACKGROUND

The present invention relates to the microwave generation, amplification, and processing arts. It particularly relates to traveling wave tubes for microwave amplifiers and microwave oscillators, and will be described with particular reference thereto. However, the invention will also find application in other devices that operate at microwave frequencies, and in other devices that employ slow wave circuits.

Traveling wave tubes typically include a slow wave circuit defined by a generally hollow vacuum-tight barrel with optional additional microwave circuitry disposed inside the barrel. An electron source and suitable steering magnets or electric fields are arranged around the slow wave circuit to pass an electron beam through the generally hollow beam tunnel. The electrons interact with the slow wave circuit, and energy of the electron beam is transferred into microwaves that are guided by the slow wave circuit. Such traveling wave tubes provide microwave generation and microwave amplification.

Heretofore, commercially produced traveling wave tubes have been limited to about 65 GHz. However, future applications call for traveling wave tubes that operate at frequencies of 100 GHz or higher. For space-based applications these high frequency devices will probably be driven at operating voltages of 20 kV or less in accord with presently available space-based electrical power sources.

Construction of high frequency traveling wave tubes is difficult using existing traveling wave tube manufacturing techniques. Designs for high frequencies call for microwave circuitry with very small features (for example, repetition periods of less than 0.2 mm), and greatly reduced quantities of dielectric insulation material in the tube to reduce dielectric loading. Moreover, adequate heat sinking becomes an increasingly significant issue as the operating frequency increases.

In one known method for manufacturing traveling wave tubes, a fragile three-dimensional microwave circuit shell, such as a metallic helix, is compressively secured in a generally hollow cylindrical barrel. Dielectric rods arranged parallel to the helical axis of the microwave circuit act as standoff insulators that align and secure the compressed microwave circuit shell inside the barrel.

To ensure good thermal contact between the components, the compressive forces are substantial. The fragile microwave circuit shell and dielectric rods are compressively secured in the barrel by briefly heating the barrel during insertion to induce temporary thermal expansion of the barrel. The microwave circuit shell/dielectric rods combination has close tolerances with respect to the barrel, and so when the barrel contracts upon cooling the interior components are compressively secured in the barrel. However, the heating and compression can damage the slow wave circuit, and mass production by this method is difficult. Moreover, this technique is not well suited for the small structures used in devices that are preferred for 100 GHz or higher operation.

To achieve features on the delicate scale called for in high frequency operation, lithographic techniques are regularly used in the electronics industry. However, these techniques are generally applied to planar wafer substrates of silicon or other semiconductor materials. Lithographic techniques are not readily adapted to produce the types of finely detailed three-dimensional structures called for in traveling wave tubes designed for high frequency operation.

To reduce dielectric loading, the dielectric rods can be replaced by thin dielectric standoff chips of natural diamond. In one constructed device described in *A Millimeter-Wave TunneLadder TWT* (D. Wilson, NASA Contract Report 182183, 1988), diamond chips with heights of 250 microns each were used in a traveling wave tube that operated at 28 GHz. However, this device has not been replicated to date due to the cost of natural diamond and the assembly difficulties, especially relating to positioning of the diamond chips. Moreover, scaling such a device up to 100 GHz or higher frequency would call for a large number of diamond chips (e.g., about 80–150 diamond chips for a 2–3 cm long traveling wave tube designed for 100 GHz operation) each having a height of about 75 microns or thinner. These reduced dimensions and increased numbers of diamond chips would further exacerbate an already difficult manufacturing process.

The present invention provides an improved apparatus and method.

SUMMARY

According to one embodiment, a slow wave circuit of a traveling wave tube is provided, including a three-dimensional conductive structure. A dielectric film coats selected portions of the three-dimensional conductive structure. An outer housing surrounds the three-dimensional conductive structure. The outer housing includes interior surfaces that contact the dielectric film.

According to another embodiment, a method is provided for generating or amplifying microwave energy. A generally hollow three-dimensional electrically conductive structure is formed. The three-dimensional conductive structure is laser micromachined to define a selected generally periodic pattern on the conductive structure. The conductive structure is arranged inside a generally hollow barrel. An electron beam is passed through the generally hollow three-dimensional conductive structure. The electron beam interacts with the conductive structure and the hollow barrel to generate or amplify the microwave energy.

According to yet another embodiment, a slow wave circuit of a traveling wave tube is provided. The slow wave circuit includes a three-dimensional electrically conductive shell having at least one laser micromachined gap defining a pattern selected to interact with microwaves in the traveling wave tube. The conductive structure is disposed inside a generally hollow barrel. The barrel includes interior vanes. Dielectric standoff insulators are arranged between the interior vanes of the barrel and the electrically conductive shell. The dielectric standoff insulators include laser micromachined gaps corresponding to the at least one laser micromachined gap of the three-dimensional shell.

Numerous advantages and benefits of the present invention will become apparent to those of ordinary skill in the art upon reading the following detailed description of the preferred embodiments.

BRIEF DESCRIPTION OF THE DRAWINGS

The invention may take form in various components and arrangements of components, and in various process operations and arrangements of process operations. The drawings are only for the purpose of illustrating exemplary embodiments and are not to be construed as limiting the invention.

DETAILED DESCRIPTION OF THE PREFERRED EMBODIMENTS

Figure 1B:
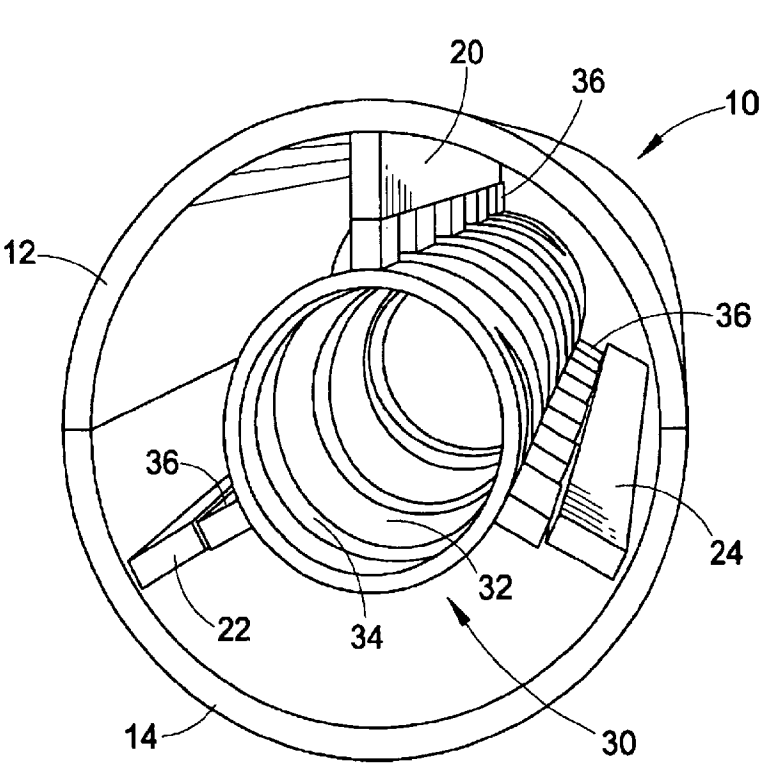
FIGS. 1A and 1B show an exploded perspective view and a perspective view, respectively, of a portion of a first exemplary slow wave circuit of a traveling wave tube.
Figure 1A:
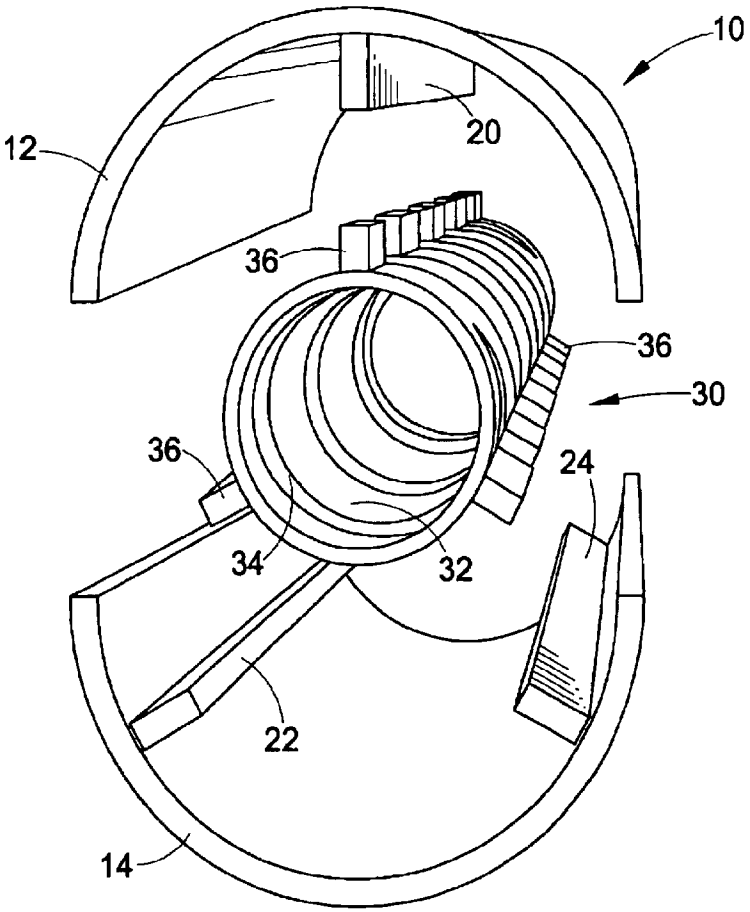

FIGS. 1A and 1B show a portion of a slow wave circuit 10 of a traveling wave tube. The slow wave circuit 10 includes first and second outer shell pieces 12, 14 that collectively define a generally hollow cylindrical barrel with three interior ridges or vanes 20, 22, 24 arranged at 120° intervals around the interior of the assembled generally cylindrical barrel. The vanes 20, 22, 24 extend generally inward toward a center of the slow wave circuit 10. Vane 20 extends from the first outer shell piece 12, while vanes 22, 24 extend from the second outer shell piece 14. The outer shell pieces 12, 14 are suitably constructed from copper or amzirc (copper with a small amount of zirconium alloyed in) by stamping, casting, or another method, and are brazed or otherwise bonded together to form the barrel.

Figure 2B:
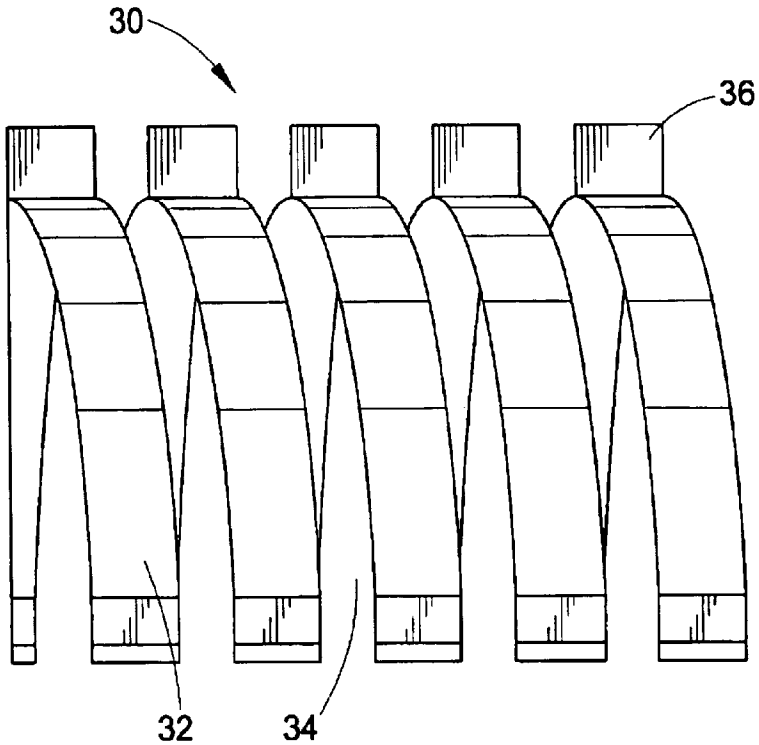
FIGS. 2A and 2B show a perspective view and a side view, respectively, of the portion of the three-dimensional conductive structure of the slow wave circuit portion of FIGS. 1A and 1B.
Figure 2A:
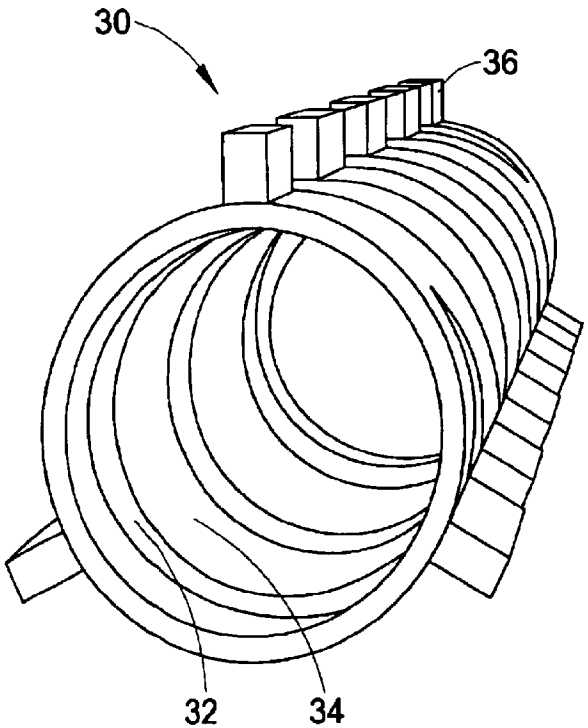

With continuing reference to FIGS. 1A and 1B, and with further reference to FIGS. 2A and 2B, the slow wave circuit 10 also includes a three-dimensional electrically and thermally conductive structure 30, which in one suitable embodiment is a generally hollow metal shell 32 with a helical cut 34 formed therein. Thus, the conductive structure 30 is a generally helical structure. The conductive structure 30 includes standoff insulators 36 which in a suitable embodiment are a selectively deposited diamond film. To promote good diamond film adhesion along with good electrical and thermal properties, the conductive structure 30 is preferably a molybdenum or tungsten structure, although other metals can also be used. Moreover, other insulators can be used, such as dielectric material brazed to the conductive structure 30. The standoff insulators 36 are bonded to surfaces of the vanes 20, 22, 24 to secure the conductive structure 30 inside the vaned barrel. In one suitable attachment, brazing is used to bond the standoff insulators 36 with the vanes 20, 22, 24. Preferably, the vanes 20, 22, 24 are made of amzirc or coated with amzirc to promote the brazed bonding.

In one exemplary embodiment designed for operation at about 100 GHz, the slow wave circuit 10 has a length of about 2 cm to 3 cm, and the helical conductive structure 30 has a helical pitch (axial distance between adjacent helical turns) of around 0.20 mm to 0.22 mm. In this design, the metal helical turns are each around 0.06 mm to 0.08 mm wide, and the helical gap is around 0.14 mm wide. For a length of 2 cm to 3 cm, the helical conductive structure 30 includes around 90 to 150 helix turns. Thus, it will be appreciated that the FIGURES show substantially enlarged views of small exemplary portions of the total length of the slow wave circuit 10.

In the exemplary 100 GHz design, the barrel defined by the assembled outer shell pieces 12, 14 has an inner diameter of about 0.7 mm, while the helical slow wave circuit 10 has an outer diameter of about 0.3 mm. In design simulations, a ratio between a thickness of the dielectric standoff insulator film 36 and an inwardly extending length of the vanes 20, 22, 24 of about 1:4 has been found to provide especially good microwave characteristics. In the exemplary 100 GHz design, this corresponds to a thickness of the dielectric standoff insulator film 36 of about 40 microns, and an inwardly extending length of the vanes 20, 22, 24 of about 160 microns.

These values are for an exemplary 100 GHz design. Those skilled in the art can readily compute specific dimensions of the slow wave circuit that provide selected electrical and microwave characteristics. Generally, reducing the thickness of the standoff insulator film reduces dielectric loading and enhances performance. However, at some point continued thinning of the dielectric produces excessive electrical conductance or other deleterious effects. Preferably, the diamond film is less than about 90 microns thick.

In operation, the slow wave circuit 10 is inserted into an evacuated portion of a traveling wave tube, and an electron beam is passed through the hollow interior of the conductive structure 30, that is, along the helical axis. Interaction with the slow wave circuit 10 causes energy transfer from the electron beam to microwaves guided in the slow wave circuit 10.

Figure 4:
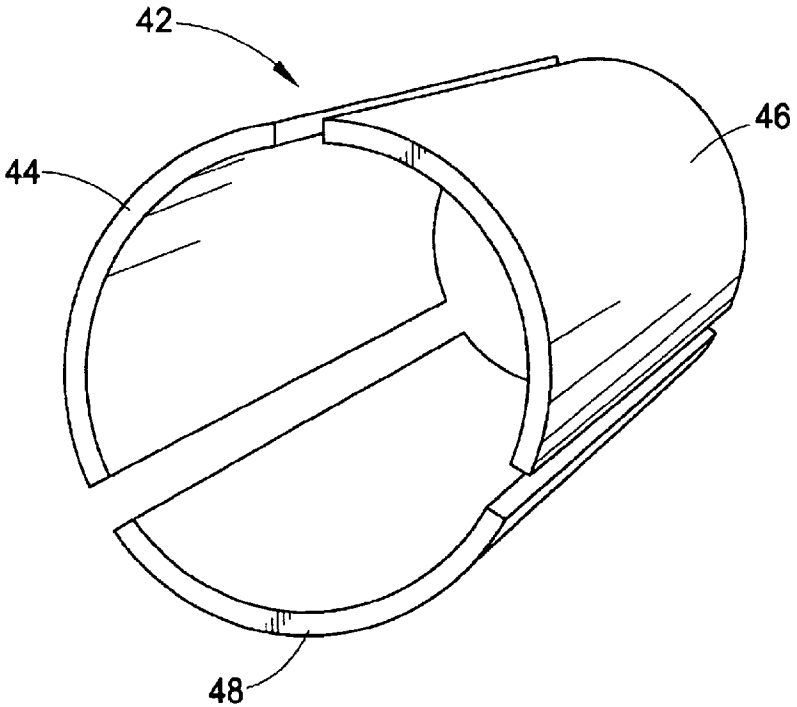
FIG. 4 shows a portion of a shadow mask for selectively depositing diamond stripes on the metal shell of FIG. 3.
Figure 3:
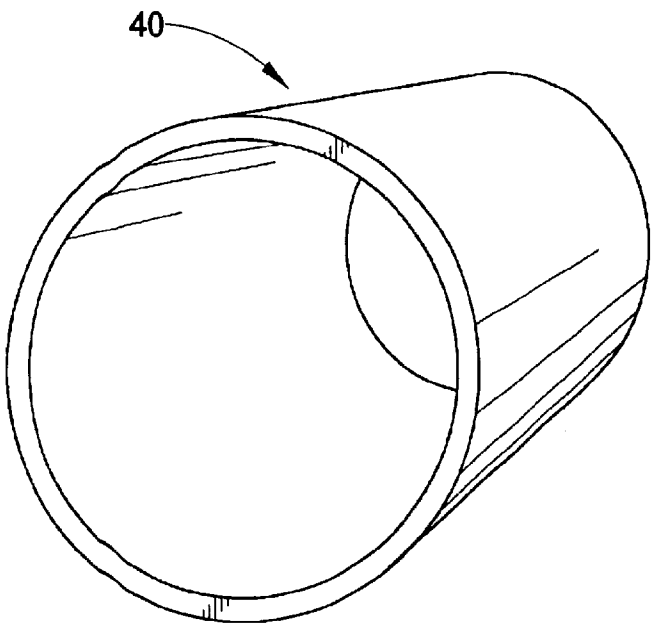
FIG. 3 shows a portion of a generally hollow cylindrical metal shell from which the three-dimensional conductive structure of FIGS. 2A and 2B is constructed.

With reference to FIGS. 3 through 6B, a suitable method for constructing the conductive structure 30 is described. FIG. 3 shows a hollow cylindrical metal shell 40 from which the conductive structure 30 is manufactured. FIG. 4 shows a shadow mask 42 for masking deposition of the dielectric diamond layer. Specifically, the shadow mask 42 includes three substantially cylinder portions 44, 46, 48 that, as shown in FIGS. 5A and 5B, conformably fit about the hollow cylindrical metal shell 40 to define exposed surface stripes 50, 52, 54 arranged at 120° intervals around the metal shell 40.

Figure 5B:
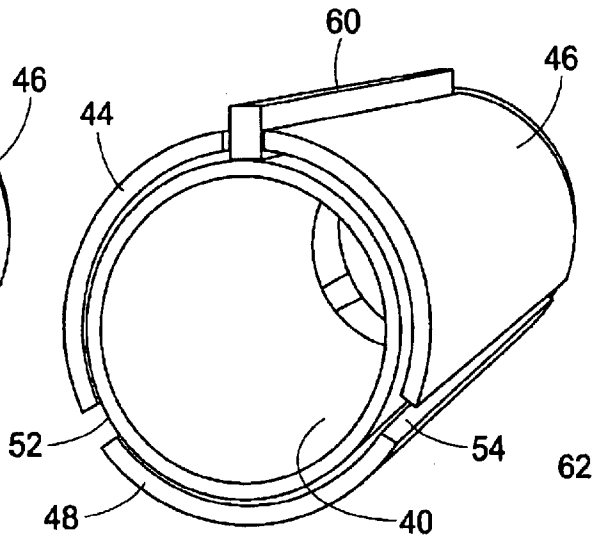
FIGS. 5A and 5B show a shadow masked chemical vapor deposition process for forming diamond stripes spaced apart at 120° intervals around the metal shell of FIG. 3.
Figure 5A:
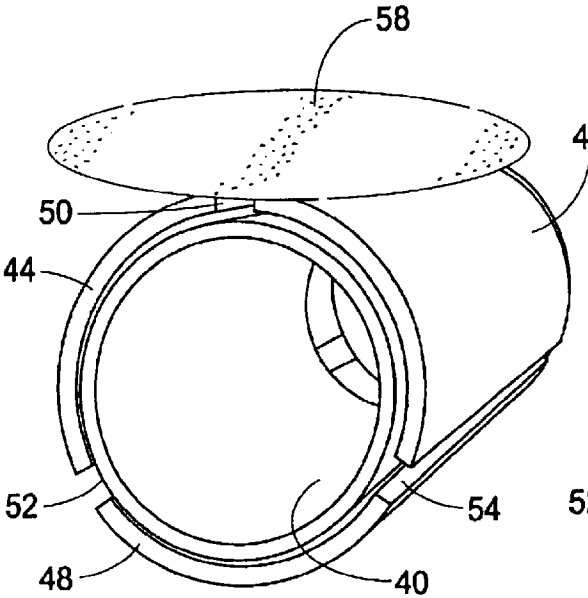

As shown diagrammatically in FIG. 5A, a chemical vapor deposition source applies a diamond stripe 60 coating the exposed surface stripe 50. The exposed surface stripes 52, 54 are similarly coated to generate corresponding diamond stripe coatings 62, 64 spaced at 120° intervals around the metal shell 40, and the shadow mask 42 is removed to leave the intermediate structure 70 shown in FIG. 6. Optionally, three chemical vapor sources spaced at 120° intervals around the metal shell 40 can provide simultaneous diamond coating of all three exposed surface stripes 50, 52, 54 in a commercial environment.

Diamond insulating stripe coatings deposited by chemical vapor deposition are preferred. Such stripe coatings are readily manufactured and provide high thermal conduction that is uniform along the stripes 50, 52, 54. However, other dielectric materials and methods can be used. For example, thin dielectric strips of insulating material can be brazed onto the metal shell 40.

Figure 6:
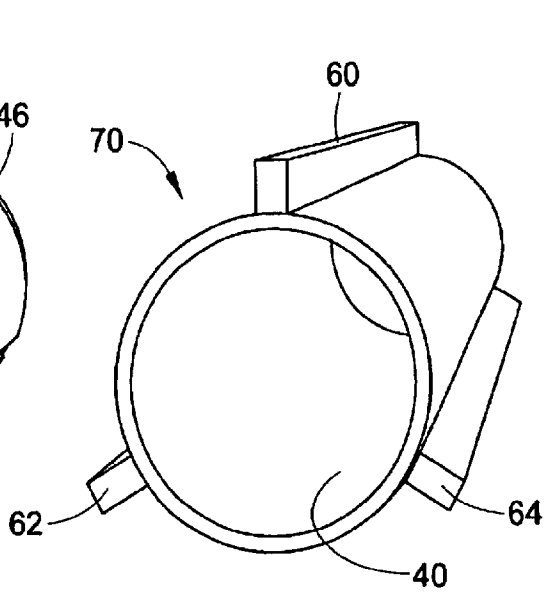
FIG. 6 shows an intermediate structure portion including the cylindrical metal shell of FIG. 3 with diamond stripes spaced apart at 120° intervals around the metal shell.

With reference to FIGS. 2A, 2B, and 6, the helical gap 34 is cut into the intermediate structure 70 to produce the helical conductive structure 30. The cutting of the helical gap 34 includes cutting both the cylindrical metal shell 40 and the diamond stripe coatings 60, 62, 64. In a preferred embodiment, the helical gap 34 is cut using three-dimensional laser micromachining, for example using a pulsed YAG laser or other type of laser producing a beam that is absorbed by metal and/or diamond. Laser micromachining is performed, for example, by the Laser Micromachining Division of Norman Noble, Inc., located in Cleveland, Ohio.

FIGS. 1–6 describe an embodiment that includes a three-dimensional helical conductive structure. However, substantially any slow wave circuit with specific desired characteristics can be similarly constructed.

Figure 7B:
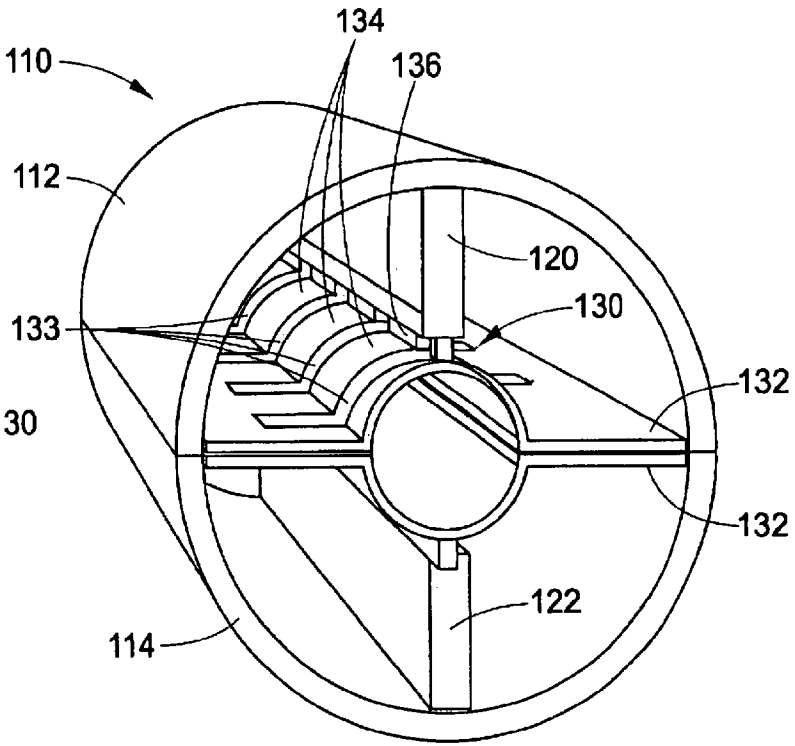
FIGS. 7A and 7B show an exploded perspective view and a perspective view, respectively, of a portion of a second exemplary slow wave circuit of a traveling wave tube.
Figure 7A:
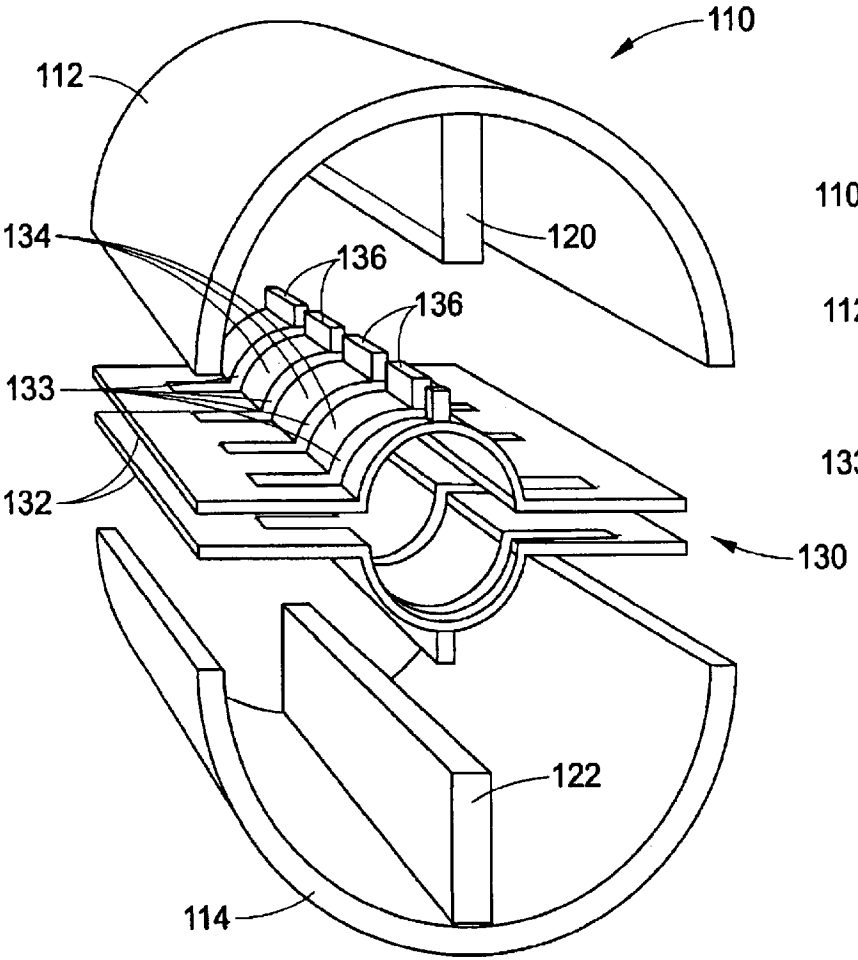

For example, FIGS. 7A and 7B show a portion of another slow wave circuit 110 of a traveling wave tube, which includes a ladder-type conductive structure. The slow wave circuit 110 includes first and second outer shell pieces 112, 114 that collectively define a barrel which is a generally hollow ridged waveguide with two interior ridges 120, 122 arranged at 180° opposed positions in the interior of the assembled generally cylindrical waveguide. The ridges 120, 122 extend generally inward toward a center of the slow wave circuit 110. The outer shell pieces 112, 114 are suitably constructed from copper or amzirc (copper with a small amount of zirconium alloyed in) or some other active metal by stamping, machining, or another method, and are brazed or otherwise bonded together to form the ridged waveguide.

The slow wave circuit 110 also includes a three-dimensional electrically and thermally conductive structure 130 formed by two symmetric, mating ladder structure pieces 132 which in one suitable embodiment are shaped metal sheets. The metal sheets are shaped so that the two mating structure pieces 132 define a generally cylindrical central hollow region coinciding with the central portion of the hollow waveguide. The ladder structure pieces 132 are brazed or otherwise bonded together.

Figure 8D:
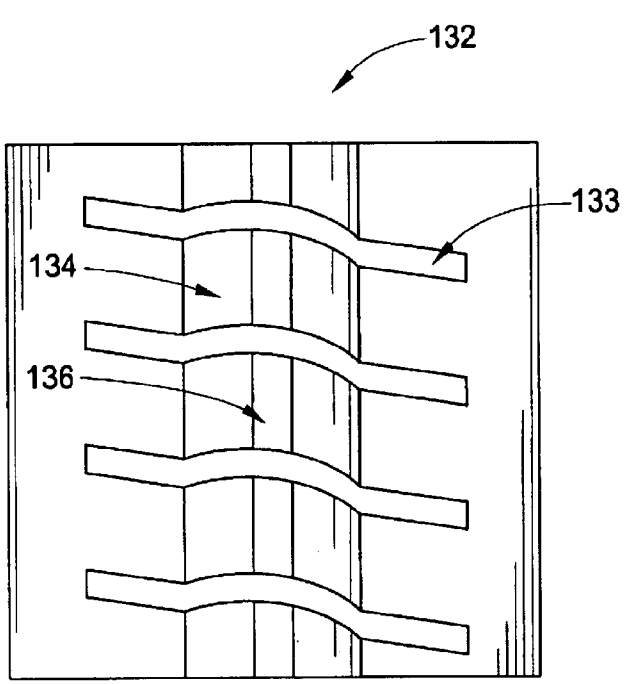
FIGS. 8A–8D illustrate a suitable process for producing the three-dimensional conductive structure of the slow wave tube of FIGS. 7A and 7B.
Figure 8A:
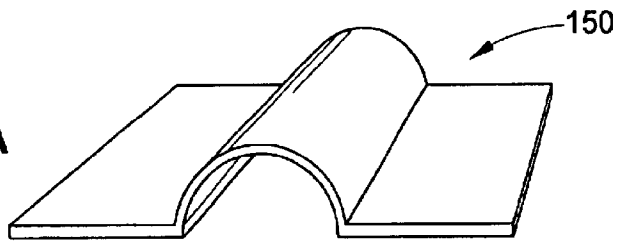
Figure 8B:
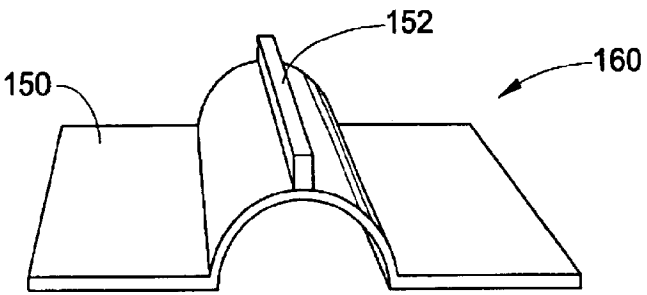
Figure 8C:
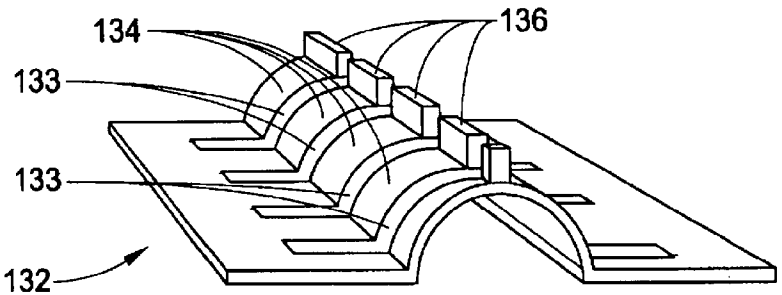

With continuing reference to FIGS. 7A and 7B, and with additional reference to FIGS. 8C and 8D, slots or gaps 133 in the ladder structure pieces 132 define a spatially periodic array or ladder of spaced apart metal sheet portions 134. The conductive structure 130 further includes standoff insulators 136 which in one embodiment are a diamond film selectively deposited on the ladder structure metal sheet portions 134. The standoff insulators 136 are bonded to the ridges 120, 122 to secure the conductive structure 130 inside the ridged waveguide. In one suitable attachment, brazing is used to bond the standoff insulators 136 with the ridges 120, 122. Preferably, the ridges 120, 122 are made of amzirc or coated with amzirc or some other active metal to promote the brazed bonding.

In one suitable embodiment for 100 GHz operation, the slow wave circuit 110 has dimensions of order 2–3 cm in length, cylindrical diameter of order 1 mm, and a ladder period of less than 0.5 mm, and preferably about 0.1–0.3 mm. Hence, it will be appreciated that the slow wave circuit 110 includes of order 50–300 or more gaps 33. The FIGURES show an exemplary enlarged axial portion of the slow wave circuit 110 and components thereof. These values are for an exemplary 100 GHz design. Those skilled in the art can readily compute specific dimensions of the slow wave circuit that provide selected electrical and microwave characteristics.

With reference to FIGS. 8A–8D, a suitable method for manufacturing the ladder structure pieces 132 is described. A shaped metal sheet 150 is processed by depositing a diamond stripe coating 152 thereon. To promote diamond adhesion along with good electrical and thermal characteristics, the metal sheet 150 is preferably a molybdenum or tungsten metal sheet, although other metals can be used. The diamond stripe 152 can be deposited using a shadow mask similar in function to the shadow mask 42 (see, e.g., FIG. 4) but shaped to conform with the metal sheet 150 and to expose the stripe region. Alternatively, a lithographic process can be used to define an exposed region corresponding to the diamond stripe 152, followed by chemical vapor deposition of the stripe coating 152. In yet another suitable approach, a diamond coating is applied to substantially the entire surface of the formed metal sheet 150, and film portions other than the stripe 152 are subsequently removed by lithographically masked etching.

The stripe 152 is preferably a diamond coating deposited by chemical vapor deposition. Such a coating is readily manufactured and provides intimate contact between the stripe 152 and the formed metal sheet 150 which promotes high and uniform thermal conduction therebetween. However, other dielectric materials and methods can be used. For example, a thin dielectric strip of insulating material can be brazed onto the formed metal sheet 150.

The metal sheet 150 with the diamond stripe coating 152 defines an intermediate structure 160. The intermediate structure 160 is suitably processed by laser micromachining to cut the slots or gaps 133 in the metal sheet 150 and the diamond stripe 152 to produce the final ladder structure piece 132. Although laser micromachining is a preferred method for forming the slots or gaps 133, other methods can be used, such as lithographic methods.

The described slow wave circuits 10, 110 are exemplary only. Other types of high frequency microwave circuitry can be similarly constructed. Laser micromachining enables substantially any type of cut, slot, or other opening to be formed into a metal or dielectric structure. Chemical vapor deposition combined with laser micromachining and/or lithography can be used to place diamond standoff insulators essentially anywhere on the microwave circuitry. Other dielectric materials besides diamond can also be used, such as diamondlike carbon (DLC), born nitride or other boron-based films, or the like.

Additionally, the dielectric standoff insulator films can be deposited on interior surfaces of the exterior housing rather than on the three-dimensional conductive structure. Although generally cylindrical barrel-shaped exterior housings are illustrated, rectangular or otherwise-shaped housings can also be used. Waveguides other than ridged waveguides can be used. Moreover, the methods described herein are also applicable to fabricating three-dimensional microwave circuitry for other applications besides traveling wave tubes.

Those skilled in the art will recognize substantial performance benefits in the disclosed traveling wave tubes and their equivalents. The combination of laser micromachining and chemical vapor deposition enable reliable and readily manufacturable formation of smaller features (e.g., periodic ladder structures, helices, standoff insulator heights and lateral dimensions, and the like) compared with previously employed methods. Smaller features enable higher frequency operation and reduced dielectric loading.

Static forces between the barrel and the conductive structure disposed therewithin are generally noncompressive. Rather than a compression fit typically used heretofore in traveling wave tube construction, the exemplary traveling wave tubes here described employ brazed joining of component parts of the traveling wave tube. This substantially reduces compressive forces on the fragile conductive structure 30, 130 disposed in the barrel.

These aspects enable substantial improvement in the gain-bandwidth product. Low dispersion traveling wave tubes in which the phase velocity is substantially independent of frequency are readily achieved. Thermal aspects are also improved due to the intimate physical and thermal contact between the deposited diamond layer and the three-dimensional conductive structure.

The invention has been described with reference to the exemplary embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A slow wave circuit of a traveling wave tube, the slow wave circuit including:

a three-dimensional conductive structure;

a dielectric film coating selected portions of the three-dimensional conductive structure; and an outer housing surrounding the three-dimensional conductive structure, the outer housing including interior vanes extending inward toward the conductive structure to connect with the dielectric film, a ratio of a thickness of the dielectric film to an inwardly extending length of the interior vanes being about 1:4.

2. A slow wave circuit of a traveling wave tube, the slow wave circuit including:

a three-dimensional electrically conductive shell having at least one laser micromachined gap defining a pattern selected to interact with microwaves in the traveling wave tube;

a generally hollow barrel inside of which the conductive structure is disposed, the barrel including interior vanes; and dielectric standoff insulators arranged between the interior vanes of the barrel and the electrically conductive shell, the dielectric standoff insulators including laser micromachined gaps corresponding to the at least one laser micromachined gap of the three-dimensional shell.

3. The slow wave circuit as set forth in claim 2, wherein the at least one laser micromachined gap defines a pattern including one of a ladder structure and a generally helical structure.

4. The slow wave circuit as set forth in claim 2, wherein the dielectric standoff insulators include:

a chemical vapor deposition film deposited on portions of one of the three-dimensional conductive structure and the interior vanes of the barrel.

5. The slow wave circuit as set forth in claim 2, wherein the dielectric standoff insulators include:

at least one dielectric strip brazed to the three-dimensional conductive structure and including laser micromachined gaps corresponding to the at least one laser micromachined gap of the three-dimensional shell.

6. A slow wave circuit of a traveling wave tube, the slow wave circuit including:

a three-dimensional conductive structure;

a dielectric film coating selected portions of the three-dimensional conductive structure; and an outer housing surrounding the three-dimensional conductive structure, the outer housing including interior surfaces that contact the dielectric film;

wherein static forces between the three-dimensional conductive structure and the outer housing surrounding the three-dimensional conductive structure are generally noncompressive.

7. The slow wave circuit as set forth in claim 6, wherein the dielectric film is selected from a group consisting of a diamond film and a boron nitride film.

8. The slow wave circuit as set forth in claim 6, wherein the outer housing includes:

a plurality of outer shell pieces that are bonded together to define a unitary outer housing.

9. The slow wave circuit as set forth in claim 6, wherein the outer housing includes:

a plurality of outer shell pieces that are brazed together to define a unitary outer housing.

10. The slow wave circuit as set forth in claim 6, further including:

a thermally conductive joining material disposed between the dielectric film and the interior surfaces, the joining material joining the dielectric film and the interior surfaces.

11. The slow wave circuit as set forth in claim 10, wherein the joining material includes:

a brazing filler material.

12. The slow wave circuit as set forth in claim 6, wherein the three-dimensional conductive structure includes:

a non-planar metal sheet with gaps formed therein that define an array of spaced-apart metal sheet portions.

13. The slow wave circuit as set forth in claim 12, wherein the dielectric film is disposed on the spaced-apart metal sheet portions.

14. The slow wave circuit as set forth in claim 6, wherein the outer housing includes:

interior vanes extending inward toward the conductive structure to connect with the dielectric film being disposed on the interior projections.

15. The slow wave circuit as set forth in claim 14, wherein the three-dimensional conductive structure includes:

a conductive generally helical structure.

16. The slow wave circuit as set forth in claim 15, wherein the outer housing is generally cylindrical and the interior vanes include three interior vanes spaced at 120° intervals about the generally cylindrical outer housing.

* * * * *